United States Patent [19]

Sasaki

[11] Patent Number: 4,552,313

[45] Date of Patent: Nov. 12, 1985

[54] METHOD AND APPARATUS FOR SWITCHING YARN IN TURRET-TYPE WINDER

[75] Inventor: Yasusuke Sasaki, Osaka, Japan

[73] Assignee: Teijin Limited, Osaka, Japan

[21] Appl. No.: 618,164

[22] Filed: Jun. 7, 1984

[30] Foreign Application Priority Data

Jun. 7, 1983 [JP] Japan ..... 58-100145

[51] Int. Cl.[4] ..... B65H 54/06; B65H 54/42; B65H 67/04

[52] U.S. Cl. ..... 242/18 A

[58] Field of Search ..... 242/18 A, 18 DD, 18 R, 242/18 PW, 25 A, 35.5 A, 45

[56] References Cited

U.S. PATENT DOCUMENTS

| | | | |
|---|---|---|---|
| 4,033,519 | 7/1977 | Abe et al. | 242/18 A |
| 4,298,171 | 11/1981 | Fluckiger et al. | 242/18 A |
| 4,394,986 | 7/1983 | Hasegawa et al. | 242/18 R |
| 4,487,374 | 12/1984 | Sugioka et al. | 242/18 A |

FOREIGN PATENT DOCUMENTS

| | | | |
|---|---|---|---|
| 120368 | 9/1979 | Japan | 242/18 A |
| 6867 | 1/1983 | Japan | 242/18 A |
| 6868 | 1/1983 | Japan | 242/18 A |

*Primary Examiner*—Stanley N. Gilreath

*Attorney, Agent, or Firm*—Sughrue, Mion, Zinn, Macpeak & Seas

[57] ABSTRACT

In a turret type automatic winder, a method for automatically switching a yarn from a package to an empty bobbin when doffing the package, in which a bobbin holder carrying the package is preliminary accelerated by an acceleration disc for maintaining a yarn tension in a proper range before yarn switching with a preset urging force of the acceleration disc onto the bobbin holder increased continuously or stepwisely corresponding to a size of the package. An apparatus for carrying out the above method comprises a pressure control means for a fluid operating a rotary actuator utilized for urging the acceleration disc onto the bobbin holder, which means includes a cam displaceable with a growth of the package and a regulator valve actuated by the cam for outputting a regulated pressure to the rotary actuator.

15 Claims, 13 Drawing Figures

METHOD AND APPARATUS FOR SWITCHING YARN IN TURRET-TYPE WINDER

BACKGROUND OF THE INVENTION

1. Field of the Invention

The present invention relates to method and apparatus for switching a yarn from a package to a fresh bobbin utilizing a so-called turret-type automatic yarn winder. Particularly, it relates to an improvement of the abovesaid method and apparatus regarding the acceleration of the package during the yarn switching operation.

2. Description of the Prior Art

Usually, a synthetic yarn spun from a spinneret is taken up on a bobbin as a package by a winder, in which the bobbin is held on bobbin holder and is driven by a surface contact with a rotating friction roller. When the package grows to a predetermined size, the running yarn is cut and temporarily sucked into an aspirator or a suction gun, during which the package is doffed from the bobbin holder and, in place, a fresh bobbin is donned thereto and, thereafter, the yarn is manually threaded from the aspirator to the empty bobbin to restart the take-up operation. However, such an operation consumes much suction air and produces considerable amount of waste material.

To eliminate the abovesaid drawbacks of the prior art, a so-called turret type automatic winder is proposed, for example, in Swiss Patent Specification No. 513,763 and U.S. Pat. No. 4,033,519. According to the turret type winder, a pair of bobbin holders are held on the opposite ends of a rotatable turret. Each bobbin holder is alternately displaceable from the normal winding position to the doffing position by every half a rotation of the turret. When the package is to be exchanged with an empty bobbin, the turret is made to rotate half a turn, whereby the package held on one bobbin holder is moved to the doffing position and, simultaneously, the empty bobbin held on the other bobbin holder is brought to the winding position. During the passage of this displacement, the yarn connected to the package is automatically transferred to the empty bobbin without using the aspirator or the suction gun.

The turret type winder is increasingly utilized for taking up a rather coarser yarn. However, when it is utilized for a yarn of medium or finer thickness, the yarn switching operation is not always successfully performed. That is, the yarn switching operation tends to fail when the size (weight) of the package to be doffed is largely deviated from the standard one.

The present inventors have found that the yarn tension during the yarn switching operation has a serious influence on the success rate of this operation.

As stated before, the turret-type winder is put to practical use for taking up the coarser yarn intended for industrial usage or for a tire cord. This is because such a yarn has a sufficient strength to be durable even against a larger fluctuation (particularly an increase) of the tension during the yarn switching operation and, therefore, a precise control of the tension is unnecessary.

A reason why the tension variation is generated is described below in detail. In this regard, though the explanation is made mainly on the friction drive winder in which the package is driven by surface contact with the friction roller positively driven at a constant peripheral speed, this principle is also applicable to other types such as a spindle drive type in which the bobbin holder itself directly drives the bobbin.

In general, a yarn tension in the normal winding operation of the friction drive winder is kept substantially constant. This is true in the case of the turret type automatic winder having a pair of bobbin holders. During the passage of rotation of the turret for exchanging the position of the package to that of the empty bobbin, the package on the one bobbin holder is detached from the friction roller at a certain angular position and, in turn, the empty bobbin on the other bobbin holder is brought into contact with the friction roller so as to start winding. In this stage, the yarn from the source such as a spinneret is still being wound on the package now being free from the friction roller. Therefore, if the package is kept free as it is, the winding speed of the yarn is gradually decelerated causing the lowering of the yarn tension. For enhancing the yarn switching operation, the yarn tension has to be kept in a preferable range. Thus, the acceleration of the package with a suitable timing is necessary or, otherwise the yarn switching operation tends to fail; that is, if the yarn tension is too high, the yarn is broken down before being transferred to the empty bobbin and, on the contrary, if too low, the yarn cannot engage with a yarn catching means provided on the empty bobbin such as a yarn catching groove or tape.

For smooth yarn switching in the conventional turret type winder, the empty bobbin is preliminarily accelerated by a suitable driving means to have a periphery speed of substantially the same as the yarn feeding speed and, thereafter, the package released from the friction roller is also accelerated by the same driving means now detached from the empty bobbin so that the yarn speed is controlled so as not to be greatly changed from the normal winding speed and the yarn tension is kept in a suitable range. Such the method is disclosed, for example, in Japanese Unexamined Patent Publication Nos. 49-100351 and 50-4342, and U.S. Pat. No. 4,033,519.

The abovesaid method may be effective when the timing for initiating the acceleration of the package is suitably selected. However, such a timing has to be modified in accordance with the size of the package. Therefore, if various size packages are sequentially treated in one winder, the success rate of the yarn switching operation tends to drop to a great extent. The recent synthetic fiber industry is required to manufacture many kinds of packages having various forms and dimensions in accordance with the market needs. Besides this, the package being wound on the winder often has to be exchanged for a fresh bobbin before it has reached the predetermined full size due to many reasons such as yarn breakage during the winding or waste winds in the start-up period, whereby the package subjected to the yarn switching may have various sizes in a range of from a bobbin with only a few yarn layers to a full package.

If the success rate of the yarn switching operation is low, there are required exclusive operators for the threading operation, which is contradictory to the object of the provision of the automatic winder, i.e., reduction of labour, and results in increased cost for the product.

SUMMARY OF THE INVENTION

It is an object of the present invention to provide a method by which a yarn can be stably switched from the package to the empty bobbin on the turret type winder irrespective of the size of the package to be treated.

It is another object of the present invention to provide an apparatus for successfully carrying out the abovesaid method.

The above-mentioned objects of the present invention are achievable by, in a turret type automatic winder in which a pair of bobbin holders are arranged on a rotatable turret with each bobbin holder being capable of alternately occupying a winding position and a doffing position, every half a turn of said turret, wherein a yarn is continuously taken up on a bobbin held on the one bobbin holder in the winding position to form a package and an empty bobbin is held on the other bobbin holder in the doffing position, a method for automatically switching the yarn from the package to the empty bobbin when the package grows to a predetermined size, by half a turn of the turret while accelerating the two bobbin holders so that a proper yarn tension is kept characterized in that a driving torque to accelerate the bobbin holder carrying the package is positively increased corresponding to growth of the package.

The abovesaid method is preferably carried out by a turret type automatic winder, comprising a pair of bobbin holders arranged on a rotatable turret, each bobbin holder being capable of occupying two positions alternately, a winding position and a doffing position, by every half a turn of the turret; a friction head carrying a friction roller, the friction roller driving said bobbin holder in the winding position by a surface contact therebetween to take up a yarn on a bobbin held on the bobbin holder to form a package, the friction head being displaceable corresponding to growth of the package to maintain a proper contacting pressure between the friction roller and the package; the turret being rotated half a turn when the package reaches a predetermined size for switching the yarn from the package on the one bobbin holder to an empty bobbin on the other bobbin holder, characterized in that the winder comprises an acceleration disc held at an end of an arm rotatable in a plane parallel to that of the turret; a rotary actuator operated by a fluid for rotating the arm in the normal and reverse directions to urge the acceleration disc against either of the bobbin holders; a regulator valve for adjusting a pressure of said fluid supplied to the rotary actuator; a cam means provided on the friction head for varying an output pressure of the regulator valve corresponding to the displacement of the friction head; and means for temporarily fixing the output pressure of said regulator valve during the yarn switching operation, whereby the urging force of the acceleration disc onto the bobbin holder is adjustable corresponding to the diameter of the package so that the yarn tension immediately before yarn switching is kept in a range suitable for the yarn switching operation.

BRIEF DESCRIPTION OF THE DRAWINGS

The other advantages and featurs of the present invention will be apparent from the description of the preferred embodiments with reference to the accompanying drawings: wherein.

DESCRIPTION OF THE PREFERRED EMBODIMENTS

Figure 1:
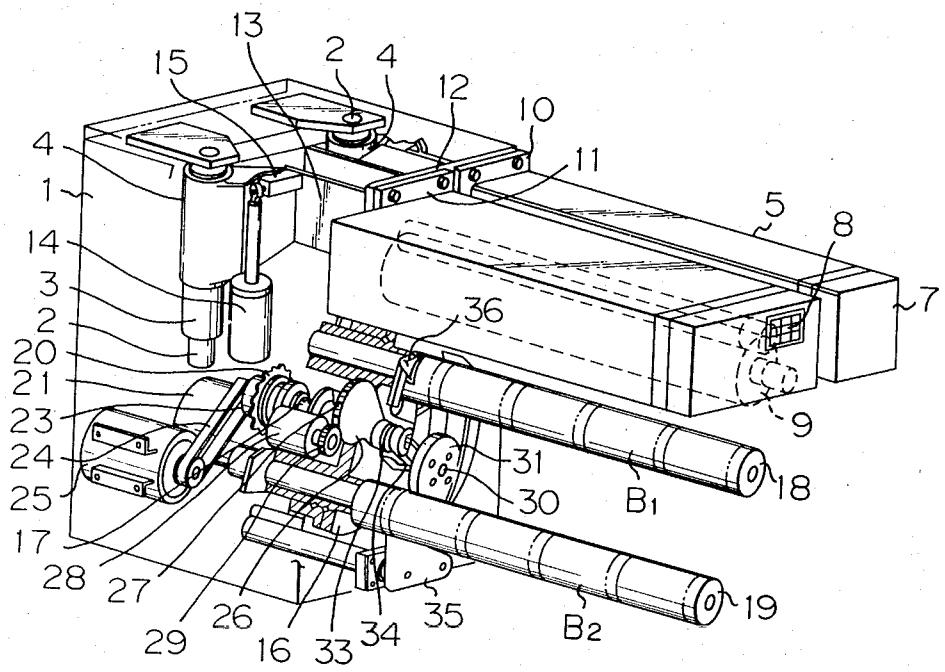
FIG. 1 is a partially sectioned schematic perspective view of a turret type automatic winder embodying the present invention.
Figure 2:
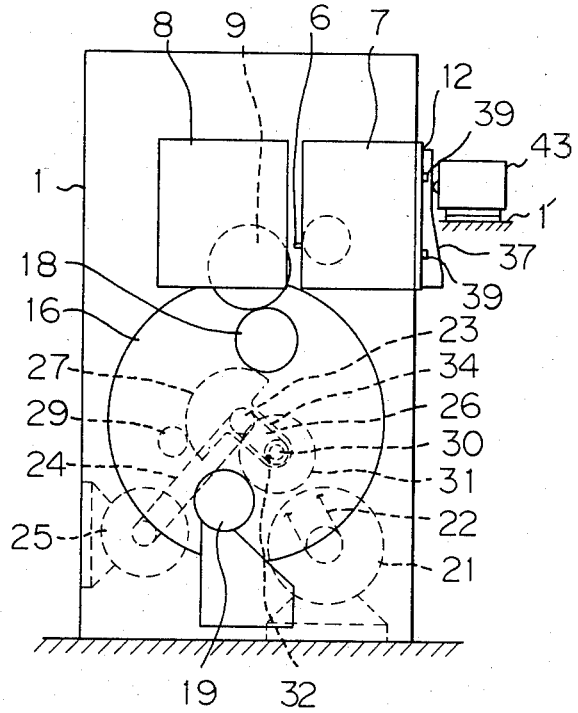
FIG. 2 is a schematic front view of the winder shown in FIG. 1.

In FIGS. 1 and 2, a turret type automatic winder according to the present invention is illustrated.

On a machine frame 1, a pair of slide shafts 2,2 are fixedly mounted and extend downward therefrom. On each slide shaft 2, a slide block 4 is mounted with a slide bearing 3 slidably along the shaft 2.

Reference numeral 5 designates a friction head comprising a traverse motion box 7 having a traverse guide 6 for reciprocating a yarn to be wound on a package and a positively rotating friction roller 9 with a covering 8. The friction head 5 is mounted to the slide blocks 4,4 by an a L-shaped bracket 13 which, in turn, carries a holder 12, on which rear side flanges 10, 11, respectively, of the traverse motion box 7 and of the covering 8 are fixedly secured. According to this construction, the friction head 5 is movable up and down with guidance of the slide blocks 4 along the slide shafts 2. A power cylinder 14 is provided for displacing the friction head up and downward to regulate the contacting pressure of the friction roller on the package to be wound.

A turret 16 is disposed below the friction head 5 in a rotatable manner about a shaft 17. The turret 16 rotatably supports a pair of bobbin holders 18, 19 arranged symmetrically and parallel relative to the shaft 17.

The rotational direction of the turret 16 when the yarn switching operation is carried out is preferably reverse to the winding direction of the bobbin holders 18 and 19 about their own axis.

The shaft 17 is driven by a motor 21 through a chain 22 and a sprocket 20, whereby the turret 16 is also made to rotate. The shaft 17 is a hollow tube, through which an axle 23 extends. The axle 23 can be driven by a motor 25 through a pulley (not shown) secured at rear end of the axle 23 and a timing belt 24 as best seen in FIG. 2.

On the extension of the axle 23 projected in front of the turret 16 is pivotally mounted an arm 26. The arm 26 has a sector portion at outer end thereof provided with teeth 27, to which a pinion 29 secured on a shaft of a reversible rotary actuator (refer to as air motor hereinafter) 28 is intermeshed. According to this construction, the arm 26 can be made to swing about the axle 23 by the action of the air motor 28.

The opposite end of the arm 26 beyond the axle 23 fixedly carries another shaft 30 extending parallel to the axle 23. On the shaft 30 is rotatably mounted a pulley 32 integrated with an acceleration disc 31 for frictionally driving the bobbin holder 18 or 19. The pulley 32 is connected to the axle 23 through a pulley 33 secured on outer end of the axle 23 and a timing belt 34. According to this construction, the acceleration disc 31 can be made to rotate about its own axis by the rotation of the motor 25.

Other known means are also provided in the winder, such as a pusher 35 for dismounting the package $B_1$ from the bobbin holder 19 or two brakes 36 for stopping the rotation of the bobbin holders 18, 19, respectively (though in FIG. 1, only one brake for the bobbin holder 18 is illustrated for simplicity).

The similar constructions of the turret type winder as stated above is disclosed in U.S. Pat. No. 4,033,519.

According to the winder of this type, the arm 26 carrying the acceleration disc 31 is made to rotate about the axle 23 by the air motor 28 in synchronism with the rotation of the turret 16 in order to engage the acceleration disc 31 to the bobbin holder for accelerating the latter with a proper timing during the yarn switching operation. As stated before, both bobbin holders on the turret may be driven by the acceleration disc 31. However, it has been found that a careful control is needed, particularly, for the bobbin holder carrying the package because it has a larger inertia than the other. In the conventional method, a contacting pressure of the acceleration disc 31 to the bobbin holder 18 is kept constant irrespective of the package size, whereby the yarn switching operation often fails when the package size is altered.

According to the present invention, the contacting pressure is positively made to vary corresponding to the package size held on the bobbin holder at a time when the yarn switching operation is carried out. One embodiment of this pressure control means is explained below.

Figure 3:
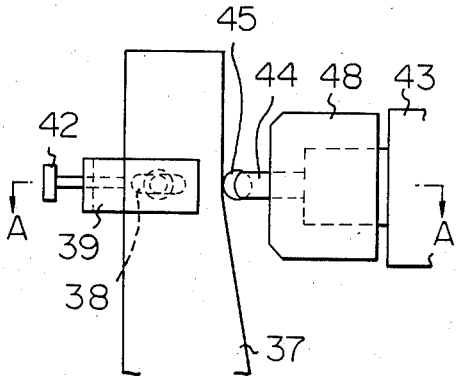
FIG. 3 is an enlarged view of part of FIG. 2 illustrating a cam means according to the present invention.
Figure 4:
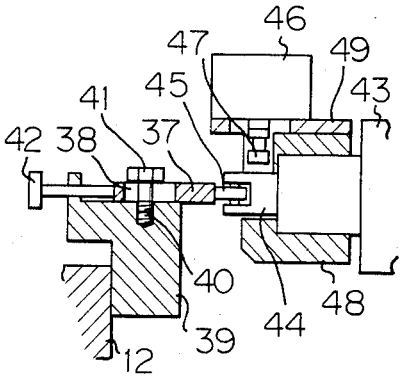
FIG. 4 is a sectional plan view of the cam means along A—A plane of FIG. 3.

In FIGS. 3 and 4, a plate cam 37 is secured on the holder 12 of the friction head 5 by means of a pair of bracket 39. The cam 37 has a laterally elongated hole 38 through which a screw 41 is threaded into a bore 40 provided on the bracket 39, whereby the cam 37 is fixed on the holder 12 while the position thereof is adjustable (in the horizontal direction) within the range of the elongated hole 38. To facilitate the positional adjustment of the cam 37, an adjust screw 42 is provided on the bracket 39.

A regulator valve 43 for a compressed air is mounted on the machine frame 1 with its movable rod 44 confronting the plate cam 37. The regulator valve 43 has the function to output compressed air controlled to a preset pressure which is variable corresponding to the projecting length of the movable rod 44. The rod 44 has a cam follower 45 at its tip end, through which the rod 44 is urged onto the contact surface of the plate cam 37. As the diameter of the package on the bobbin holder 18 grows larger, the friction head 5 gradually rises up in a known manner to maintain a contacting pressure of the friction roller 9 to the package constant. This movement of the friction head 5 causes a relative displacement of the cam follower 45 to the plate cam 37, whereby, the movable rod 44 is pushed into a housing of the regulator valve 43 (in this embodiment, push-in of the rod 44 means a higher output pressure of the regulator 43). As stated later, the output air from the regulator valve 43 is supplied to the air motor 28 for operating the arm 26 carrying the acceleration disc 31. Since the torque of the air motor 28 is substantially proportional to the supplied air pressure, this means that the acceleration disc 31 can be urged on the bobbin holder 18 with a contact pressure varying with the package diameter.

An air cylinder 46 is mounted on the machine frame 1 by means of a bracket 48 with the interposition of a spacer 49 between the bracket 48 and the air cylinder 46. The air cylinder 46 is disposed beside the movable rod 44 of the regulator valve 43 in such a manner that a presser 47 fitted on a tip end of a plunger of the air cylinder 46 can be urged onto a side surface of the movable rod 44 so as to maintain a position of latter and to set an output pressure of the regulator valve 43 when the air cylinder 46 is operated as will be stated later in detail. Of course, any suitable means other than one described above may be adopted for setting the regulator valve 43, such as a wheel or rack and ratchet mechanism provided directly or indirectly on the movable rod 44, which functions as an anti-reverse rotational means and registers a continuous or stepwise displacement of the movable rod 44. In the drawings, though the plate cam 37 and the regulator valve 43 are illustrated as if they are arranged outside of the machine frame 1 for the sake of simplifying the explanation, they are, of course, preferably built-in inside of the machine frame so as to minimize the overall installation of the winder.

Figure 5A:
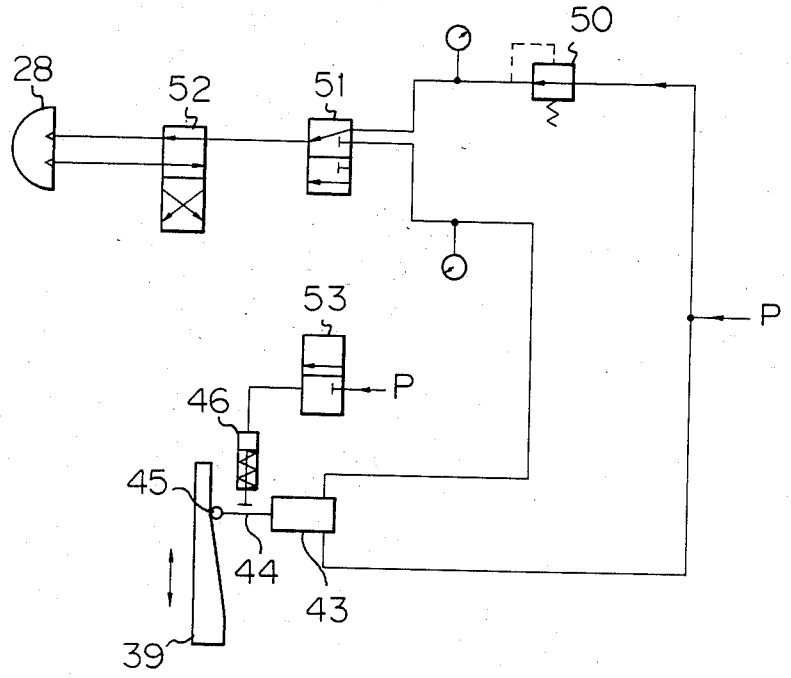
FIGS. 5A and 5B are piping diagrams for compression air for actuating an air motor for driving an acceleration disc shown in FIG. 1.

FIG. 5A shows a schematic piping circuit for compressed air operating the pressure control means before commencement of the yarn switching operation. Reference numeral 50 designates a pressure reducing valve; 51, 52 changeover valves, respectively; and 53 a solenoid valve. The air motor 28 is at first energized by the compressed air from an air source P through a passage including the pressure reducing valve 50 to operate the arm 26 in the direction so as to urge the acceleration disc 31 onto the bobbin holder 19 carrying the empty bobbin.

When the solenoid valve 53 is energized, the compressed air is permitted into the air cylinder 46, whereby the plunger of the air cylinder 46 is engaged to the movable rod 44 and temporarily holds a position of the latter.

Figure 5B:
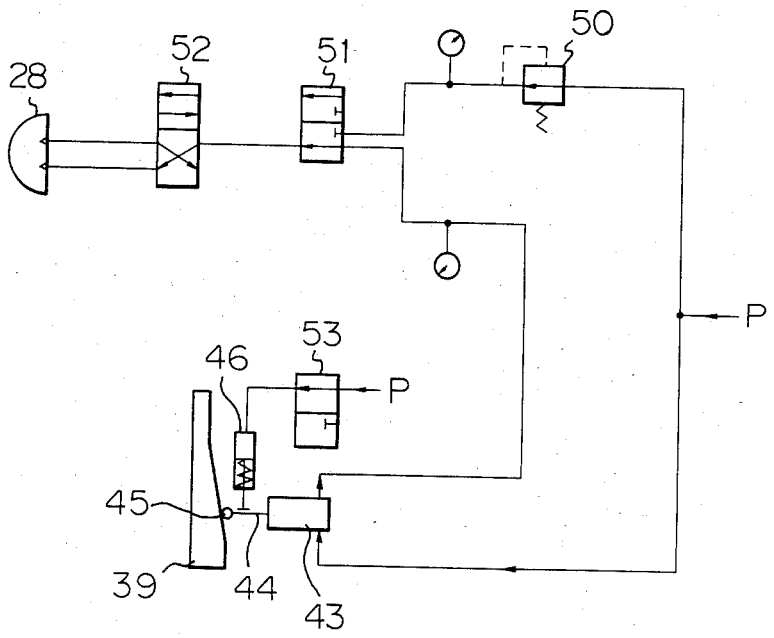

When the changeover valve 52 is operated, the direction of the compressed air introduced into the air motor 28 is reversed, whereby the air motor 28 rotates in the direction that the acceleration disc 31 comes up to the bobbin holder 18 carrying the package. Thereafter, the changeover valve 51 is operated to introduce the compressed air from another passage including the regulator valve 43 to the air motor 28 (FIG. 5B).

The plate cam 37 has a contour for contacting the cam follower 45 provided on the movable rod 44 of the regulator valve 43, which contour is of such a shape that the output pressure of the regulator valve 43 is increased as the diameter of the package becomes larger so that the urging force of the acceleration disc 31 onto the bobbin holder 18 is increased, in other words, the driving torque given to the bobbin holder 18 can be increased corresponding to the development of the package size. In most cases, the contour of the cam 37 is in the shape of a ramp composed of a straight line, but may be curvilinear or stepwise which can be selected in accordance with yarn species, yarn thickness, winding conditions or the type of regulator valve utilized. Further, as stated before, the position of the plate cam 37 can be adjusted by the adjust screw 42 so as to vary an increasing ratio of the output pressure of the regulator valve 43. This adjustment of the increasing ratio can be also achieved by the replacement of the original plate cam 37 by a new one having a different contour.

The pressure control means is not confined to the abovesaid combination of the plate cam and the regulator valve but may be replaced by a combination of a time counting means and a regulator valve in which the output pressure of the regulator valve is adjusted to vary in accordance with the time duration after the initiation of the package winding. Further, in place of varying the contacting force of the acceleration disc on the bobbin holder, it may be possible to prolong a contact time duration of the acceleration disc in accordance with the increase of package diameter.

The explanation of the pressure control means has been made on the embodiment applied to a winder having a friction head which is displaced up and down. However, this embodiment can be modified without difficulty to be applicable to the other type of winder such as one in which the friction head is moved substantially in the horizontal direction or one in which the friction head is stationary and, instead, the bobbin holder is made to be displaced as the package grows. Moreover, the acceleration means is not limited to a single disc but may be provided exclusively for each bobbin holder 18 or 19. Also, acceleration means other than the disc may be utilized. Of course, the number of bobbins held on a bobbin holder is not limited to four as illustrated in FIG. 1 but may be two or more.

The abovesaid yarn switching operation of the present invention will be described more in detail with reference to FIGS. 6A to 6D and 7.

Figure 6A:
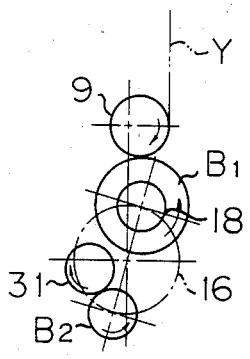
FIGS. 6A to 6D are schematic front view of the winder shown in FIG. 1 illustrating sequential steps of the yarn switching operation, respectively.
Figure 7:
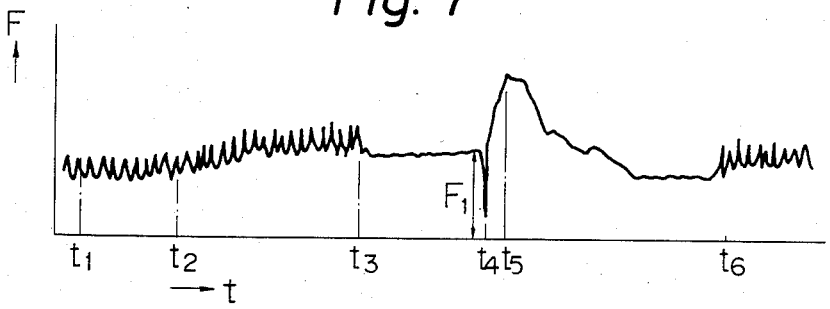
FIG. 7 is a graph illustrating a winding tension before and after the yarn switching operation in relation to the time.

When the package $B_1$ has reached the predetermined diameter at a time $t_1$ in FIG. 7, the acceleration disc 31 drives the bobbin holder 19 carrying the empty bobbin $B_2$ as shown in FIG. 6A. Since the yarn Y is being wound on the package $B_1$ on the bobbin holder 18 as usual with a traverse motion irrespective of the acceleration of the bobbin $B_2$, the yarn tension F is kept in a usual level as shown on the graph between $t_1$ and $t_2$ in FIG. 7.

Figure 6B:
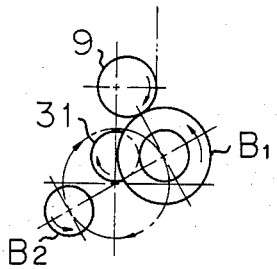
Figure 6C:
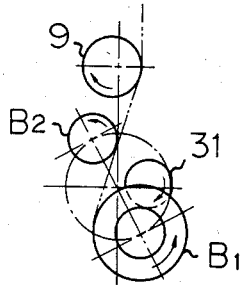

When the speed of the bobbin $B_2$ has reached the predetermined value, the turret 16 begins to rotate in the direction shown by an arrow in FIG. 6B. Simultaneously therewith, the acceleration disc 31 is reversely swung to contact the bobbin holder 18 which is now detaching from the friction roller 9. The acceleration disc 31 is urged onto the bobbin holder 18 at a time $t_2$ and begins to drive the package $B_1$ for compensating the deceleration thereof as shown in FIG. 6B. According to this acceleration, the yarn tension F is slightly increased.

At a time $t_3$ shown in FIG. 7, the yarn is released from the traverse guide 6 in a known manner and, then, is touched to the empty bobbin $B_2$ and is engaged with a yarn catching groove on the bobbin $B_2$ at a time $t_4$. The yarn tension F is greatly reduced for a moment and, thereafter, abruptly increased. Simultaneously, the empty bobbin $B_2$ falls in contact with the friction roller 9 in the vicinity of a time $t_5$, whereby the bobbin $B_2$ is forcibly driven (see FIG. 6D). At this time, the yarn Y is cut and winding of the yarn Y on the empty bobbin $B_2$ is started and yarn switching operation. is completed. After the yarn portion caught on the empty bobbin $B_2$ is lapped several times by the succeeding yarn, or a transfer tail is formed on the empty bobbin $B_2$ if required, the yarn is engaged with the traverse guide 6 and the normal winding is started at a time $t_6$.

Figure 6D:
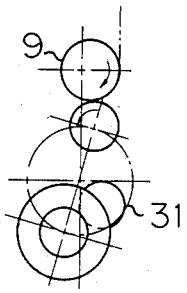

The acceleration disc 31 is held in the position shown in FIG. 6D (which corresponds to one shown in FIG. 2) until next doffing is commenced, and, in the next yarn switching operation, the arm 26 is made to rotate in the reverse direction to that shown in FIGS. 6A to 6D while performing the same steps as stated above. That is, the acceleration disc repeats normal and reverse directional movement alternately every yarn switching operation.

In the above operation, the yarn tension just before the yarn switching operation indicated by $F_1$ in FIG. 7 is important. If this tension $F_1$ is too low, the yarn Y is slackened and wrapped around the roller located upstream. If the tension $F_1$ is too high, the yarn is broken. In each case, the automatic switching is not successfully performed. Namely, in order to perform automatic yarn switching operation successfully, it is necessary to adjust the tension $F_1$ within a proper range. This range is greatly changed according to the yarn thickness, the yarn kind and the winding speed, and as pointed out hereinbefore, this range tends to float as the package size is varied. Accordingly, if the tension $F_1$ is always controlled within a proper range correspondng to the package size, failure in the yarn switching operation can be prevented.

In general, the tension $F_1$ before the yarn switching operation depends mainly on the change of the rotational speed of the package $B_1$ at the time of acceleration. The value of the tension $F_1$ is determined by the degree of acceleration of the package $B_1$ by the disc 31, that is, what extent the package $B_1$ can be accelerated.

The speed increasing rate of a rotating body is ordinarily expressed by the following formula:

$$dw/dt=(T-T_L)/I$$

wherein dw/dt stands for the speed increasing rate, w stands for the angular speed, t stands for the time duration, T stands for the driving torque, $T_L$ stands for the value of a mechanical loss converted to the form of torque, and I stands for the moment of inertia.

As seen from the above formula, the speed increasing rate dw/dt is determined by the moment of inertia I if the driving torque is constant. Namely, if the value of I is small, the value of dw/dt is larger than the value of dw/dt when the value of I is large. Since the value of I in the case of a cylindrical object is proportional to the fourth power of its diameter, the value of dw/dt is drastically changed according to the diameter thereof. Thus, the speed increasing rate dw/dt is greatly changed according to the package diameter, that is, the winding weight.

Therefore, in the present invention, the acceleration force for the package $B_1$ is controlled so that a proper tension is always attained before the yarn switching operation is carried out corresponding to the package diameter.

The abovesaid principle is embodied in the present invention as follows:

When the package $B_1$ is detected to reach a full size, for example, by counting the time duration of the winding operation, a full package signal is generated. The switch of the motor 25 is turned on by this signal, and rotation of the acceleration disc 31 is started through the axle 23. Since the acceleration disc 31 is already in contact with and urged onto the bobbin holder 19 carrying a fresh (empty) bobbin $B_2$ by the air motor 28 to which compressed air from a compressed air source P is supplied through a pressure reducing valve 50, the bobbin holder 19 is frictionally driven by the acceleration disc 31. The full package signal also makes a timer (not shown) to start for counting a time duration when the empty bobbin $B_2$ is to reach the predetermined rotational speed and upon reaching the preset time, a signal is generated from the timer. Simultaneously with receiving the signal or slightly after it, the motor 21 is started to rotate the turret 16, and, at the same time, the changeover valve 52 is actuated and sequentially the switching valve 51 follows. On the other hand, simultaneously with the generation of the full package signal or by the time of the initiation of rotation of the turret 16, the solenoid valve 53 is actuated to open the circuit to the air cylinder 46, whereby the air cylinder 46 is operated to temporarily hold the position of the movable rod 44 of the regulator valve 43 as it is.

As the yarn layer of the package $B_1$ is increased with the progress of the winding of the yarn Y, the friction head 5 rises so as to maintain the contacting pressure between the friction roller 9 and the yarn layer of the package $B_1$ at a predetermined value. Following the movement of the friction head 5, the plate cam 37 fixed on the former also moves upward whereby the movable rod 44 is pushed in the regulator valve 43 in accordance with a displacement of the cam follower 45 always urged onto the contour of the plate cam 37 to adjust the set value of the output pressure of the regulator valve 43. This set value of the regulator valve 43 is maintained as it is even after the plate cam 37 is brought down by the succeeding rotation of the turret 16 because the position of the movable rod 44 is kept by the air cylinder 46.

Thereafter, the compressed air circuit to the air motor 28 is changed over to the circuit passing through the regulator valve 43 by the operation of the changeover valves 51 and 52 as which is already stated before with reference to FIG. 5B, whereby the arm 26 for the acceleration disc 31 is urged onto the bobbin holder 18 carrying the package $B_1$ with a proper urging force predetermined by the compressed air supplied to the air motor 28 through the regulator valve 43. Accordingly, the tension at the time of yarn switching is always maintained at a proper level corresponding to the package size, and, therefore, the yarn switching operation is performed assuredly and stably irrespective of the diameter and weight of the package whereby the function or performance of the turret type automatic winder can be greatly improved.

In the abovesaid descrition, as is shown in FIGS. 6A to 6D, the rotational direction of the turret and the winding direction of the bobbin holder are preferably reverse to each other. However, the present invention is also applicable to the case in which the turret and the bobbin holder are rotated in the same direction. Further, the present invention is more preferably utilized for winding a yarn of low elongation such as a full-drawn yarn.

The above said features of the present invention will be described specifically with reference to numerical values.

Based on various experiments in the take-up of a polyethylene terephthalate filament yarn of 115 denier/36 filaments obtained by a conventional spinning system at a winding speed of 3200 m/min with a winder shown in FIG. 1, it has been confirmed that the yarn tension just before the yarn switching operation in a range of from 15 g to 55 g results in almost 100% success rate of the yarn switching operation. Then, the acceleration force (the driving torque) imparted to the bobbin holder carrying the package was adjusted by the above said cam and regulator system illustrated in FIGS. 2 through 5 so that the yarn tension just before the yarn switching operation is set within the above said range with respect to optional package diameter in the range of from 103 mm (empty bobbin) to 305 mm (full package).

Figure 8:
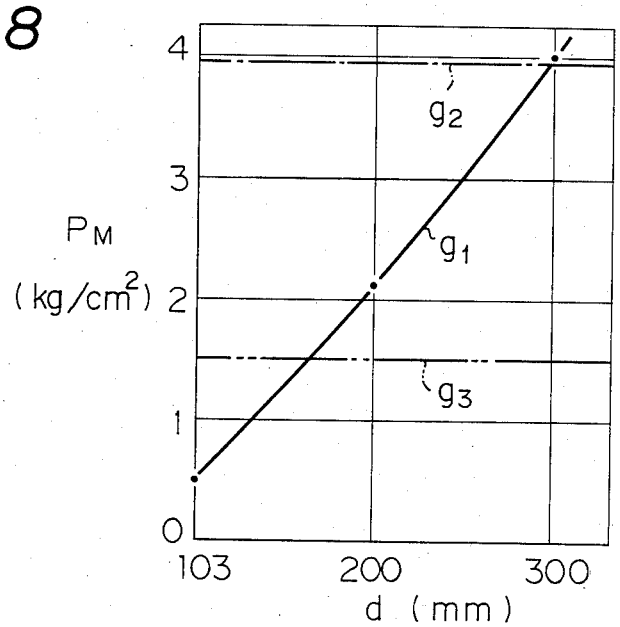
FIG. 8 is a graph illustrating a relationship between a package diameter and a pressure of the acceleration disc on the package.

The relationship between the preferable operational air pressure $P_M$ for the air motor 28 (i.e., the set value of the regulator valve 43) and the corresponding package diameter d is indicated as a curve $g_1$ depicted by a solid line in FIG. 8.

Figure 9:
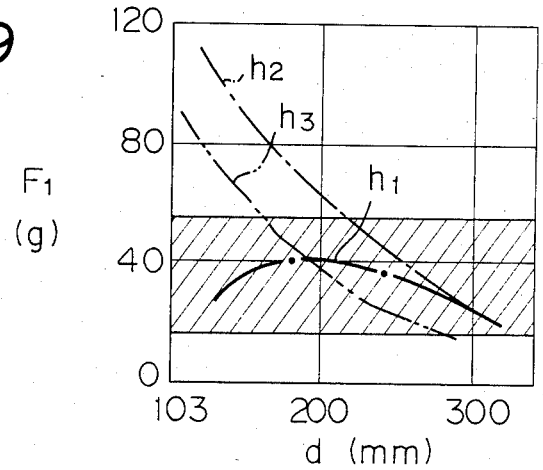
FIG. 9 is a graph illustrating a relationship between a package diameter and a winding tension just before the initiation of the yarn switching operation.

A curve $h_1$ in FIG. 9 illustrates the measured values of the yarn tension $F_1$ just before the yarn switching operation when the set values of the regulator valve 43 are adjusted so as to match with the curve $g_1$ in accordance with the package diameter. As is apparent from FIG. 9, the yarn tension $F_1$ falls in the preferable hatched region (15 g to 55 g) through the whole range of the package diameter.

On the other hand, one-dot chain lines $g_2$ and $h_2$ shown in FIGS. 8 and 9 show the results obtained in the conventional yarn switching system in which the operating pressure of the air motor, that is, the acceleration pressure $P_M$, is not changed but is fixed at 4 $Kg/cm^2$, and two-dot chain lines $g_3$ and $h_3$ show the results obtained in the conventional system in which the acceleration pressure is set at 1.5 $Kg/cm^2$.

As is seen from FIGS. 8 and 9, in the conventional system in which the acceleration pressure $P_M$ is kept constant, for example, in case of one-dot chain lines $g_2$ and $h_2$, if the package diameter is smaller than 220 mm, the tension is outside the proper range, and at this time success rate of the operation is low and the reliability of the winder as an automatic winder is very low. More specifically, according to the yarn switching method of the present invention, the success rate of the operation is 99.7 to 100% to the package diameter from the empty bobbin to the full package. In the conventional system shown by one-dot chain lines $g_2$ and $h_2$, if the winding diameter is smaller than 220 mm, success rate of the yarn switching operation is 90 to 95%, and when the package is small, the reliability is low. This effect is similarly attained even if such factors as the thickness and kind of the yarn, and the winding speed and other conditions are changed (needless to say, an appropriate tension range is changed by these factors), and the present invention can be applied in a very broad range.

A certain proper range is present for the yarn tension just before yarn switching, as described hereinbefore, but it is preferred that the cam shape and other conditions be set so that the yarn tension is maintained at a certain value within this appropriate range, for example, at about 40 g in FIG. 9.

Needless to say, the cam shape and other conditions may be set so that the tension is gradually or stepwise changed within the above-mentioned appropriate range.

1. A method for switching yarn in a turret type automatic winder in which a pair of bobbin holders are arranged on a rotatable turret with each bobbin holder being capable of alternately occupying a winding position and a doffing position upon every half turn of said turret comprising continuously taking up a yarn on a bobbin held on one bobbin holder in the winding position to form a package while an empty bobbin is held on the other bobbin holder in the doffing position, switching the yarn from the package to the empty bobbin when the package grows to a predetermined size by rotating said turret a half turn, and accelerating each of said bobbins prior to switching of the yarn from the package to the empty bobbin so that a proper yarn tension is maintained including positively increasing the driving torque for accelerating said bobbin holder carrying the package in a manner corresponding to the growth in size of the package.

2. A method according to claim 1 comprising rotating said turret and said bobbin holders in opposite directions.

3. A method according to claim 1 wherein the yarn tension immediately before yarn switching is larger than during normal winding.

4. A method according to claim 1 comprising winding said yarn using a winder of the friction drive type in which said bobbin holder is rotated by frictional contact with a positively rotating friction roller.

5. A method according to claim 4 comprising accelerating said two bobbin holders by frictional contact with an acceleration disk when the yarn switching operation is carried out.

6. A method according to claim 5 comprising accelerating said bobbin holder carrying the empty bobbin prior to accelerating said bobbin holder carrying the package.

7. A method according to claim 6 comprising adjusting the driving torque by varying the force urging said acceleration disk against said bobbin holder.

8. A turret type automatic winder comprising a frame, a turret rotatably mounted on said frame and having a pair of rotatable bobbin holders mounted thereon, means for rotating said turrent in half turn increments to position said bobbin holders alternately in a winding position and a doffing position, a friction head moveably mounted on said frame, a friction roller mounted on said friction head for driving the bobbin holder in the winding position by surface contact therebetween to take up the yarn on a bobbin held thereon to form a package, said friction head being displaceable on said frame in a manner corresponding to the growth of the package to maintain a proper contact pressure between said friction roller and the package, control means for operating said means for rotating said turret a half turn when the package reaches a predetermined size for switching the yarn from the package on one bobbin holder to an empty bobbin on the other bobbin holder, an arm rotatably mounted on said frame for rotation in a plane parallel to the rotation of said turret, an acceleration disk mounted at one end of said arm, fluid operated rotary actuator means connected to said arm for rotating said arm in opposite directions to urge said acceleration disk alternatively against each of said bobbin holders, regulator valve means associated with said fluid operated rotary actuator for adjusting the pressure of fluid supplied to said rotary actuator, cam means mounted on said friction head for varying the output pressure of said regulator valve in correspondence to the displacement of said friction head, and lock means for temporarily maintaining said output pressure of said regulator valve at a fixed value during a yarn switching operation whereby the urging force of said acceleration disk onto said bobbin holder is adjustable according to the diameter of the package so that the yarn tension immediately before yarn switching is kept in a range suitable for the yarn switching operation.

9. A winder according to claim 8 wherein said friction head is displaceable vertically in the up and down directions so that said head moves upwardly as the diameter of the package increases.

10. A winder according to claim 9 wherein said regulator valve has a body with a moveable rod projecting outwardly therefrom wherein the displacement of said rod into said body results in an increase of said output pressure for said regulator valve.

11. A winder according to claim 10 wherein said moveable rod has a tip end with a cam follower mounted thereon in the form of a roller engageable with said cam means.

12. A winder according to claim 11 wherein said cam means comprises a plate cam extending in the same direction as that of the displacement of said friction head and having a ramp portion protruding towards said regulator valve for engagement by said roller.

13. A winder according to claim 8 wherein said lock means of said regulator valve comprises an air cylinder mounted adjacent said moveable rod of said regulator valve and having a plunger moveable into engagement with said moveable rod upon operation of said air cylinder to lock said moveable rod.

14. A winder according to claim 8 further comprising fluid circuit means for supplying fluid to said rotary actuator including a first passage for supplying fluid to said rotary actuator for rotating said arm and a second passage for supplying fluid to said rotary actuator for urging said acceleration disk against said bobbin holder and changeover valve means for selectively connecting said first and second passages to said rotary actuator.

15. A winder as set forth in claim 14 wherein said regulator valve is incorporated in said second passage.

* * * * *